US005813912A

United States Patent [19]

Shultz

[11] Patent Number: 5,813,912

[45] Date of Patent: Sep. 29, 1998

[54] TRACKING AND CREDIT METHOD AND APPARATUS

[76] Inventor: James Doouglas Shultz, 2386 Dundee Cir., South Lake Tahoe, Calif. 96150

[21] Appl. No.: 676,932

[22] Filed: Jul. 8, 1996

[51] Int. Cl.[6] ..... A63F 9/00

[52] U.S. Cl. ..... 463/25

[58] Field of Search ..... 463/25, 26, 27, 463/28, 29, 42; 283/67, 70; 235/375, 380, 382, 382.5

[56] References Cited

U.S. PATENT DOCUMENTS 5,265,874 11/1993 Dickinson et al. ..... 463/25

5,503,434 4/1996 Gunn ..... 283/67

*Primary Examiner*—George Manuel

[57] ABSTRACT

A method and apparatus for automatic recording and utilization of the results of a participant's actions in an activity, and most particularly gaming activities, on a tracking card wherein each participant has an individualized tracking card which is associated with a computer network operable by a combination of the operator of the activity and the participant and wherein a credit card may be associated with the tracking card for use in providing money credits for the participant.

8 Claims, 2 Drawing Sheets

FIG. 1
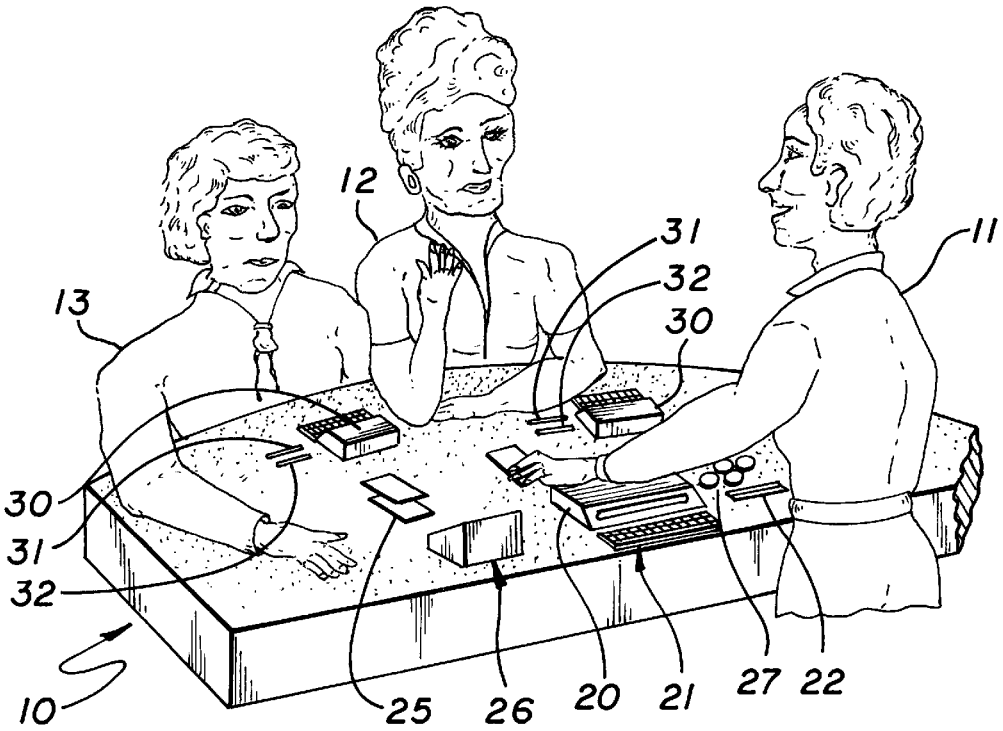
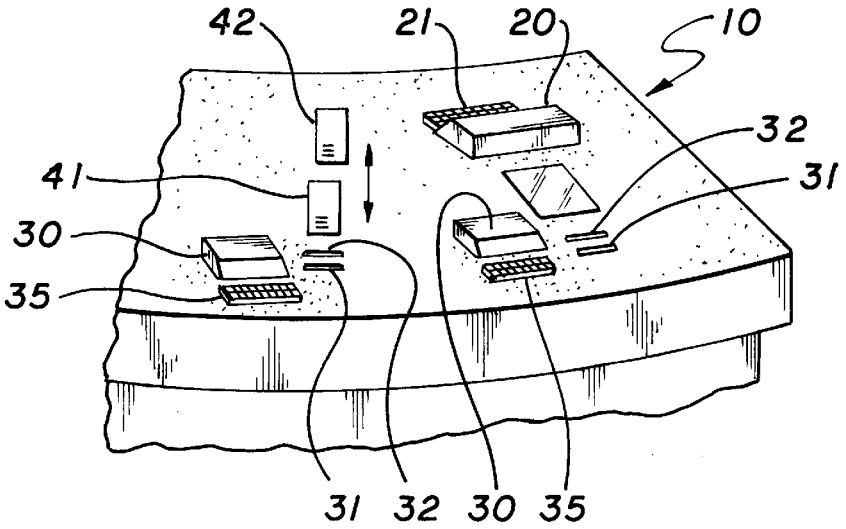
FIG. 2

DEALER
11
21
KEYBOARD
READOUT
20
51
12
13
14
15
52
53
PLAYER 1
PLAYER 2
PLAYER 3
PLAYER X
30
READOUT
KEYBOARD
42
41
32
31
58
CENTRAL CONTROL
100
55
54
56
CASINO CONSOLE
300
57
BANK CONSOLE
200

TRACKING AND CREDIT METHOD AND APPARATUS

CROSS REFERENCE TO RELATED PATENT APPLICATIONS

There are no patent applications filed by me related to this application.

BACKGROUND OF THE INVENTION

I. Field of the Invention

This invention is in the general field of tracking of the activities of individuals in participation in activities including, but not limited to, participation in games, gaming, and the like, together with automated payment and credit arrangements for, and resulting from, such participation.

II. Description of the Prior Art

There have been some minor efforts in the past to provide tracking for gambling habits in casinos and the like, where cards are issued to individuals to record their betting habits and amounts, and the like. Also, there have been some efforts at providing means for acceptance of credit cards and the like for numerous activities, including some gambling games. However, I know of no prior art where there is a provision for automatic tracking of the expenditure of money or the like in various activities, such as amusement, gaming, and the like together with use of credit arrangements wherein each individual may provide a fund for an activity (either by providing cash or cash equivalent, or through credit cards or the like) and additions and subtractions from that fund are recorded, making the fund available for transfer to another activity or for reduction to cash or the like at any given time. In this latter sense, there is no prior art known to me as to the present invention.

SUMMARY OF THE INVENTION

There are many activities in which it is desired to trace, or track, the conduct of individual participants. Such activities include participation in games, various group activities, and, importantly in gaming. Such tracing or tracking includes recording the participation of each individual.

There may be many reasons for tracking the participation of individuals. Using gaming as an example, comps (complimentary privileges extended to a participant) may be determined by the participant's amount of participation in a particular game or the like. Also, the interest generated by a particular activity can be determined, as well as the desirability of the continuance or expansion or contraction of an activity.

Many commercial concerns now track the activities of individuals by providing the individual with a tracking card on which the participation of the individual are recorded by the persons in charge of each activity. Such recordation constitutes an additional burden on the persons required to so record. Also, inaccuracies can occur in recording such information, whether by hand, electronically, mechanically, or otherwise. Another distracting activity is the exchanging of cash or the like between the operator of the activity concerned and the participant.

I have now developed a method and apparatus by which the tracking and the calculation and exchange of money or the like is automatically and accurately accomplished with minimal effort on the part of either the operator of the activity or the participant.

I have accomplished the purposes of this invention by the following: 1) A tracking card, a chip, or the like, which electronically records and identifies each financial transaction, or other action, at each activity is provided to each participant; 2) The operator of each activity is provided with a device which can read the tracking card, or the like, of each participant; 3) The device is so equipped that it can record and maintain a running balance of money or the like (or other act of participation) which is credited to, or subtracted from, the individual's balance,(or other indicator of participation) and is simultaneously recorded as a balance on the tracking card or the like; 4) The device is also provided with means to accept commonly used credit cards for the purpose of transferring amounts to the credit of the particular tracking card.

Using a gaming establishment as an example, a participant may provide the operator of a blackjack game with $100.00, which the operator records onto the particular participant's tracking card or the like. The participant may then elect to play various hands of blackjack. For example we can assume that this particular participant plays a total of ten hands, and as a result he lost $25.00. His tracking card or the like would then contain $75.00 credit. This particular participant can then elect to collect the $75.00 from the operator or he may take the tracking card or the like and go to another table or game. Assuming he goes to a Roulette table, he can utilize his tracking card or the like at the Roulette table and commence his play there. His bets will be made with the dealer or operator recording the winnings and losses. After a given period of time, if it turns out he has won $10.00, then his tracking card or the like will show $85.00, which he can cash out with the operator or he can take his tracking card or the like and proceed to another game, or to a cashier, ultimately, to cash out.

Whenever the tracking card or the like is cashed out, the particular participant will keep the tracking card or the like use at another time. The computer network of the establishment records the information from the tracking card or the like which can then be used by the establishment to evaluate that participant's activity.

A credit card acceptor may be associated with the tracking card or the like at each game or activity so that, if the participant desires, he can increase his then existing money balance on the tracking card or the like by transfer from the credit card at any time.

While an example of a gaming establishment has been used, it will be clear that a similar method and apparatus can be used for games, rides, purchases, and other activities at an amusement park, and many other types of activities.

It is an object of this invention to provide a method and apparatus for tracking activities and expenditures of a participant at an activity or group of activities;

Another object is to provide a method and apparatus for recording debits and credits to a participant in activities;

Another object is to provide a tracking card or the like which will carry a balance of money available to be used in various activities, and to be diminished or increased according to the usage by the participant.

The foregoing and other objects and advantages of this invention will become apparent to those skilled in the art upon reading the description of a preferred embodiment in conjunction with a review of the appended drawings.

BRIEF DESCRIPTION OF THE DRAWINGS

FIG. 1 is a schematic, partially broken-away, perspective of a blackjack table utilizing the method and apparatus of this invention;

FIG. 2 is a schematic, partially broken-away, view like FIG. 1, but showing the table arrangement from the players' viewpoint and with certain items of figure one not shown.

DESCRIPTION OF A PREFERRED EMBODIMENT

Figure 3:
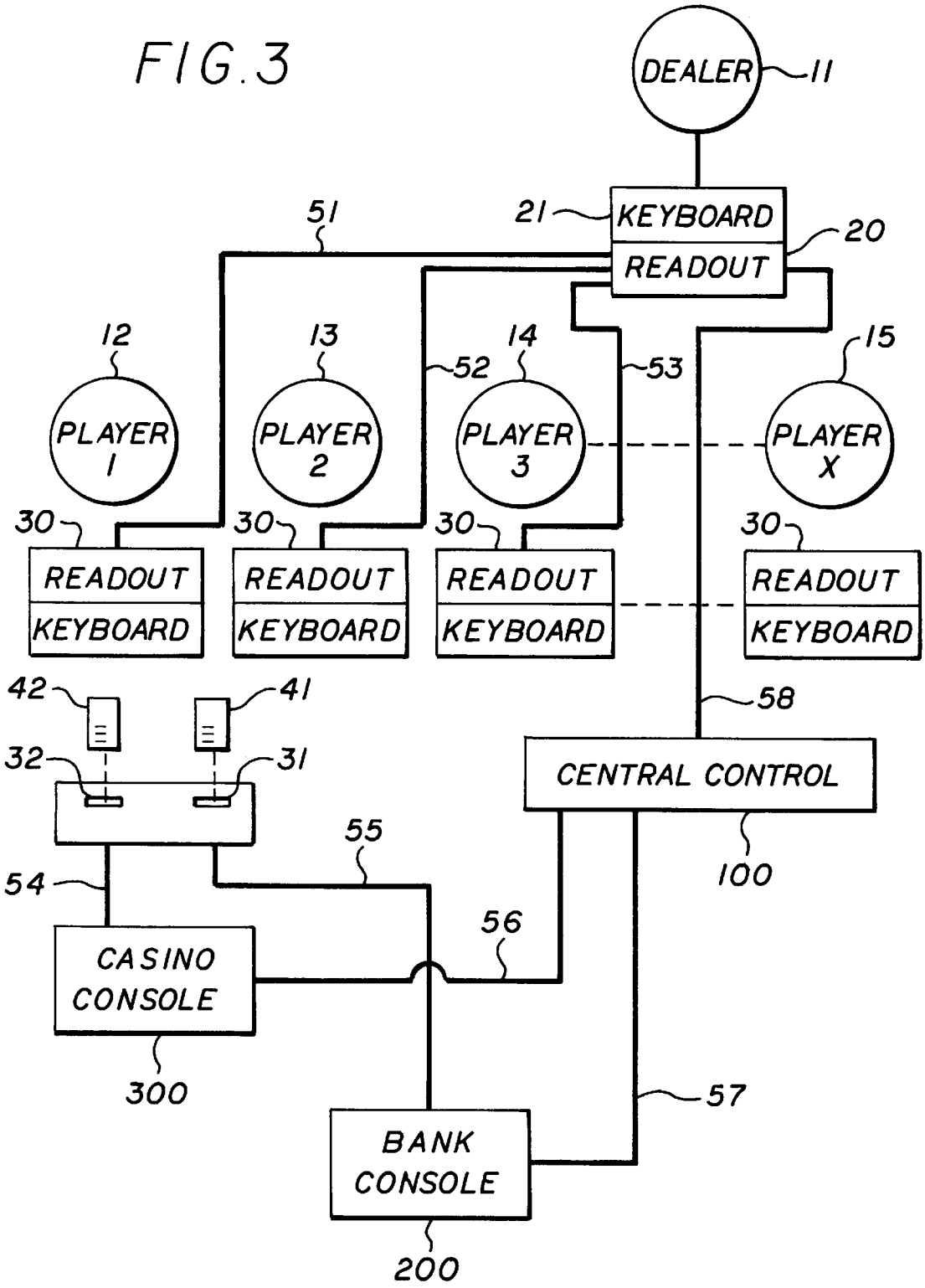
FIG. 3 is a block diagram of the operations of this invention.

FIGS. 1 and 2 show a portion of a blackjack table 10 with a dealer 11 and two players 12 and 13. The dealer has a computer 20 with keyboard 21, a card dealing shoe 26, chips or cash 27 and a customary money receiving slot 22. Each of the players has a computer 30. The computers 30 are networked with the dealer's computer in a manner known to those skilled in the art. Each player has two card acceptors 31 and 32, which are connected to the respective computers 30.

The card acceptor 31 will receive a normal credit card 41 and will be connected to the main credit card terminal of the establishment concerned. The card acceptor 32 will be suitable to read, and record on, the individual player's tracking card, or encoded device 42.

In use, the individual player will insert the tracking card 42 into the tracking card acceptor 32. The player may then pay money to the dealer, who will enter the amount paid through the dealer's computer, which will then record the amount paid through the player's computer and onto the player's tracking card. Alternatively, the player may insert his credit card 41 and enter an amount to be credited to his account at that particular game. That amount may be automatically credited to his account and recorded on his tracking card, or it may be entered by the dealer on the dealer receiving the approval from the credit organization involved, which will show on his computer readout.

For each game, the players will record their bets through their personal keyboards. The dealer will deal a hand of cards 25 to each participant. When the hand is completed, the dealer will record the results through his computer and keyboard. A player who loses will, of course, have lost that much on his card balance. If a player wins, the dealer will record that to the account on the player's card.

FIG. 3 is a block flow diagram showing the various activities and elements involved in this invention. The dealer 11 has his keyboard 21, and computer-readout 20. The dealer's computer-readout is so arranged that through connections 51, 52, 53, etc. the dealer can access each player's computer and through connection 58 will communicate with a central control 100. Each player has a display-keyboard through which the player may enter amounts to be played, and through which he can read the balance available for further play, or to cash out. Each player's tracking card 42 when inserted in the player's card acceptor 32 will communicate with the casino console 300 and central control 100 through connections 54 and 56. The player's credit card 41, when inserted in the card acceptor will communicate with the credit card console 200 through connection 55 and through that console to the central control 100 through connection 57.

When the participant's participation in the activity ceases—in the blackjack example, when the player wishes to cash out and terminate his play—he will receive the balance of cash as accounted on the tracking card. The tracking card balance will then be recorded as a zero balance. The establishment can then review the activities as recorded from the tracking card—in the case of the example of the game of blackjack, the information will all be available at the blackjack game dealer's computer and also at the central establishment control and the casino control.

One important deviation from the process described above is that card readers may be used, in which case the entire process is automated.

I have used the terms "tracking card", "credit card", "card acceptor", "computer", "recorded on", "encoded device", and the like, above, and may use some of such terms in the claims and abstract which follow. These are not meant to be limiting. It is understood that chip (memory chips) and other memory encoded devices may be used in lieu of cards and various devices for reading, or transferring, or recording, the information to or from cards or other devices may be used. It is my intention that such variations are included within such terms.

There are various modifications in the electronic and other devices which may be utilized in practicing the method herein described. The actual electronic and other details to be used in practicing this invention will be clear to those skilled in the art concerned, and the various deviations therein will be readily apparent to those so skilled.

While the embodiments shown and described are fully capable of achieving the objects and advantages desired, such embodiments are for purposes of illustration and not for purposes of limitation.

I claim:

1. The method of tracking and recording the actions of a participant in an activity comprising: supplying the participant with an encoded device which can record and memorize each of a defined number of actions of the participant; providing an overseer of the activity with means to independently record participation actions and results on the encoded device and on an independent processor; and reviewing the actions and results of the participant by the overseer.

2. The method of claim 1 wherein the encoded device records money supplied by the participant for use in the activity, the actual participation of the participant and the amount of money, and the type of participation and the results thereof are entered onto the encoded device.

3. The method of claim 2 wherein a credit card is used in conjunction with the encoded device to enter money amounts onto the encoded device.

4. The method of participating in a gaming activity comprising:

issuing an encoded device to a participant;

inserting the encoded device into a decoding and display device;

recording an amount of money available for the participant's use in the game;

displaying the amount of money available for the participant's use;

displaying an amount to be used by the participant;

participating in the game;

entering the results of the participation in the game in the encoded device;

upon completion of the game, displaying a new balance of money available to the participant;

paying the new balance of money available to the participant; and recording and analyzing the acts of the participant and the results from the encoded device;

determining the eligibility of the participant for special rewards based upon the analysis of the acts.

5. The method of claim 4 wherein a credit card is used in conjunction with the encoded device to add an amount of money available to the participant to the balance available as shown on the encoded device.

6. Apparatus for recording and analyzing the results of participation in an activity comprising:

a computer terminal with a display operable by the operator of the activity;

a computer terminal with a display for each participant in the activity;

an encoded device connectable to each participant's computer terminal;

means for the operator of the activity to record results of each participant's participation in the activity to the encoded device of each participant through the operator's terminal;

means to supplement the recorded results of each participant's participation in the activity on each participant's encoded device upon further participation by each participant in the activity; and means to evaluate the effectiveness of the activity based upon the material stored in the encoded device.

7. The apparatus of claim 6 wherein the participation consists of independent actions of each participant and the exchange of money credits between the operator and each participant based upon the independent actions of each participant.

8. The apparatus of claim 7 wherein a credit card is associated with the encoded device for supplementing money credits.

* * * * *